US005980282A

United States Patent [19]

Cheng

[11] Patent Number: 5,980,282

[45] **Date of Patent: *Nov. 9, 1999**

[54] DUAL READOUT SOCKET CONNECTOR

[75] Inventor: Lee-Ming Cheng, Cupertino, Calif.

[73] Assignee: Hon Hai Precision Ind. Co., Ltd., Taipei Hsien, Taiwan

[ * ] Notice: This patent is subject to a terminal disclaimer.

[21] Appl. No.: 09/065,760

[22] Filed: Apr. 23, 1998

Related U.S. Application Data

[63] Continuation of application No. 08/566,578, Nov. 28, 1995, abandoned, which is a continuation of application No. 08/230,068, Apr. 20, 1994, Pat. No. 5,470,242.

[51] Int. Cl.[6] ..... H01R 13/62

[52] U.S. Cl. ..... 439/157; 439/160; 439/155

[58] Field of Search ..... 439/157, 160, 439/155, 152, 153, 154, 156, 158, 159, 372, 341, 329, 326, 327, 328

[56] References Cited

U.S. PATENT DOCUMENTS

| | | | |
|---|---|---|---|
| 4,898,540 | 2/1990 | Saito | 439/153 |
| 4,990,097 | 2/1991 | Billman et al. | 439/160 |
| 5,147,211 | 9/1992 | Tondreault et al. | 439/160 |

*Primary Examiner*—Paula Bradley
*Assistant Examiner*—Tho D. Ta

[57] ABSTRACT

A card edge socket connector (1) includes an insulative elongated housing (10) having a plurality of contact slots (14) side by side vertically extending therethrough. A plurality of contacts (90) are received within the corresponding contact slots (14), respectively. A central board slot (12) extends in the housing (10) in the lengthwise direction for reception of the bottom edge portion of daughter board (100) inserted therein whereby the contacts (90) are electrically engaged with the traces on the bottom edge portion of the daughter board (100). An ejector (50) is pivotally positioned in a cavity (30) at one end of the housing (10) and a pair of separate latches (70) are positioned adjacent such ejector (50) but segregative and spaced therefrom by substantially a portion of the insulative housing (10) for latchably sandwiching and engaging within a retaining (92) hole of the daughter board (100) when the daughter board (100) is received in the board slot (12) in the connector housing (10). Such ejector (50) has a hook section (54) for pushing the bottom edge portion of the daughter board (100) upwardly and releasing the daughter board (100) from the connector (1), accordingly. The housing (10) of the connector (1) itself has a closed type opening on the top in the lengthwise direction which efficiently aligns and orients the daughter board (100) in the lengthwise direction for avoiding any misalignment of the daughter board (100) during the insertion process.

1 Claim, 7 Drawing Sheets

DUAL READOUT SOCKET CONNECTOR

This application is a continuation application of application Ser. No. 08/566,578 filed on Nov. 28, 1995, now abandoned, continuation application of application Ser. No. 08/230,068 filed on Apr. 20, 1994, U.S. Pat. No. 5,470,242.

BACKGROUND OF THE INVENTION

1. Field of the Invention

The invention relates to card edge connectors, particularly to ejection mechanism incorporating a pair of latches for releasably holding a daughter board within such socket type connector.

2. The Prior Art

U.S. Pat. No. 5,074,800 discloses a card edge connector including an ejector having latches thereon for being releasably engageable with the corresponding retaining hole in a daughter board inserted within the connector, whereby as mentioned in the Prior Art portion of the specification of '800, such combination of the engaging latch and the ejector can overcome a disadvantage of the inconvenience which requires several steps to withdraw such inserted daughter out of such card edge connector as show in U.S. Pat. Nos. 4,990,097, 5,013,264 and 5,082,459. Similar and/or improved structures are also shown in U.S. Pat. Nos. 5,167, 517, 5,207,598 and 5,211,568.

One disadvantage of the aforementioned card edge connector having such integral latch-combined ejector is that the ejector, which has a pair of opposite inwardly projecting engaging latches thereof, is designedly intended to be rotated outwardly, so that the top portion of such ejector can not help but be in an open form along the lengthwise direction of the connector housing for easily and freely receivably sandwiching the lower edge portion of the inserted daughter board between its two oppositely facing inwardly projecting engaging latches. Such opening may provide the corresponding inserted daughter board with an improper chance to be in a deviant position along the lengthwise direction of the connector housing during the insertion of the daughter board into the connector. Such unstable deviation along the lengthwise direction of the connector during insertion of the daughter board may result in offset of the inserted daughter board and damaging the circuit traces on the surfaces of the lower edge portion of such daughter board.

Accordingly, an object of the invention is to provide a card edge connector having the ejector for removal of an inserted daughter board out of the connector housing but avoiding deviation of such daughter board along the lengthwise direction during insertion.

Another object of the invention is to provide contacts in the connector wherein the connector housing has a plurality of side-by-side contact slots each of which is arranged in a neat configuration to retainably receive the corresponding contact therein and such neat configuration of each contact slot makes it easier and more convenient to form such connector housing in a molding process.

SUMMARY OF THE INVENTION

According to an aspect of the invention, a card edge connector includes an insulative elongated housing having a plurality of contact slots side by side vertically extending therethrough. A plurality of contacts are received within the corresponding contact, slots, respectively. A central board slot extending in the housing in the lengthwise direction for reception of the lower edge portion of daughter board inserted therein whereby the contacts are electrically engaged with the circuit traces on the lower portion of the daughter board. An ejector is pivotally positioned in a cavity at one end of the housing and a pair of separate latches are positioned adjacent such ejector but segregative and spaced therefrom by substantially a portion of the insulative housing for latchably sandwiching and engaging within a retaining hole of the daughter board when the daughter board is received in the board slot in the connector housing. Such ejector has a hook section for pushing the lower edge portion of the daughter board upward and releasing the daughter board from the connector, accordingly. The housing of the connector itself has a closed type opening on the top which efficiently aligns and orients the daughter board in the lengthwise direction for avoiding any misalignment of the daughter board during the insertion process.

BRIEFLY DESCRIPTION OF THE DRAWINGS

DETAILED DESCRIPTION OF THE INVENTION

References will now be made in detail to the preferred embodiments of the invention. While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by appended claims.

Figure 1:
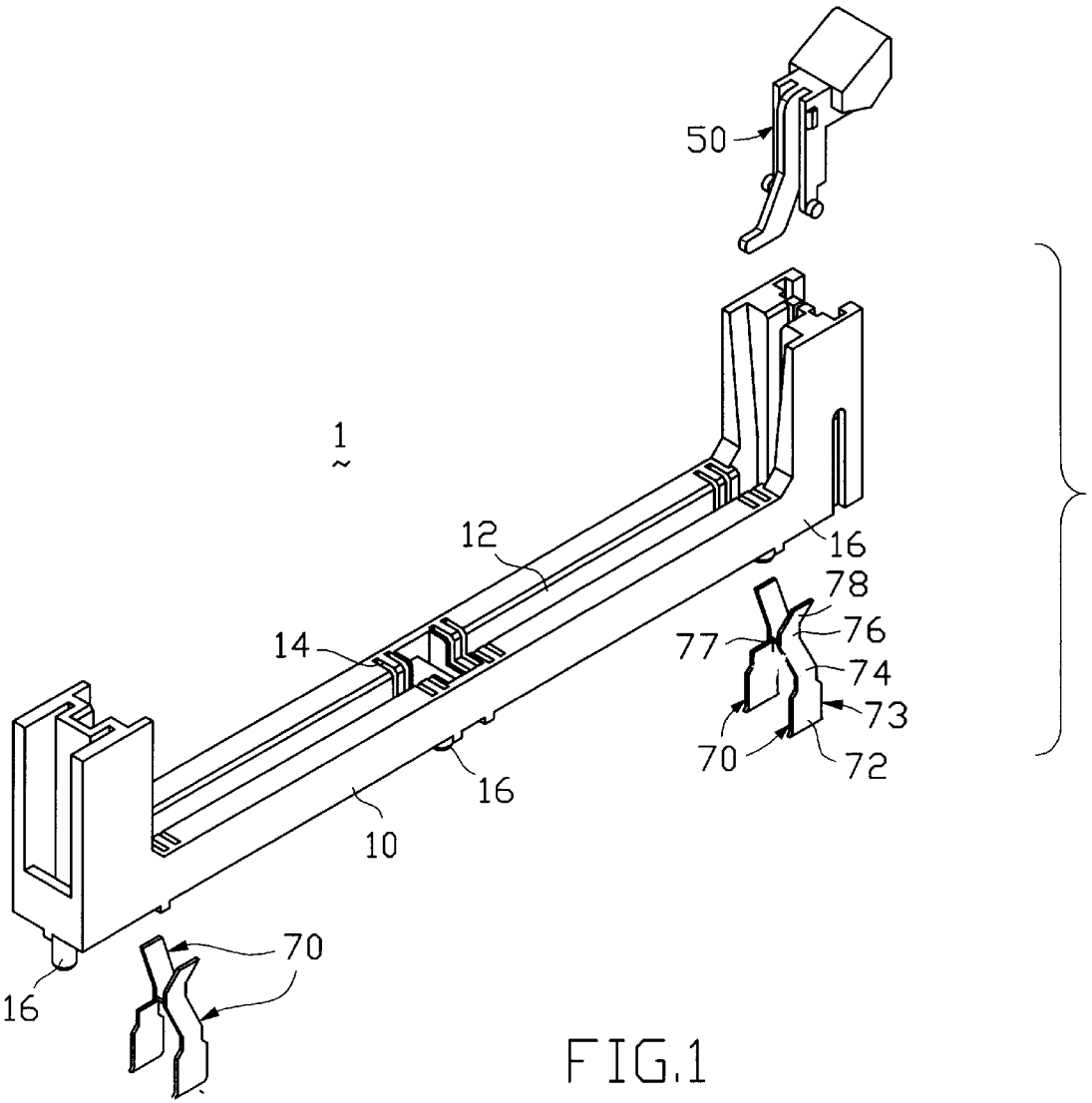
FIG. 1 is an exploded perspective view of a presently preferred embodiment of a dual readout socket according to the invention.

It will be noted here that for a better understanding, like components are designated by like reference numerals throughout the various figures in the embodiment. Attention is now directed to FIG. 1 wherein the socket 1 includes an elongated insulative housing 10 having a central board slot 12 extending in the lengthwise direction along the housing 10 for vertically receiving a daughter board (not shown in FIG. 1) therein. A plurality of contact slots 14 are side by side transversely arranged along the board slot 12 for respectively receiving a plurality of corresponding contacts (not shown in FIG. 1) therein wherein the engaging section of each contact extends into the board slot 12 so that such contacts can electrically and mechanically engage circuit traces on the bottom edge portion of the daughter board inserted in the board slot 12.

Three posts 16 are respectively disposed approximate two opposite ends and the center of the housing 10 for retainably mounting the housing 10 on a mother board (not shown).

Figure 2:
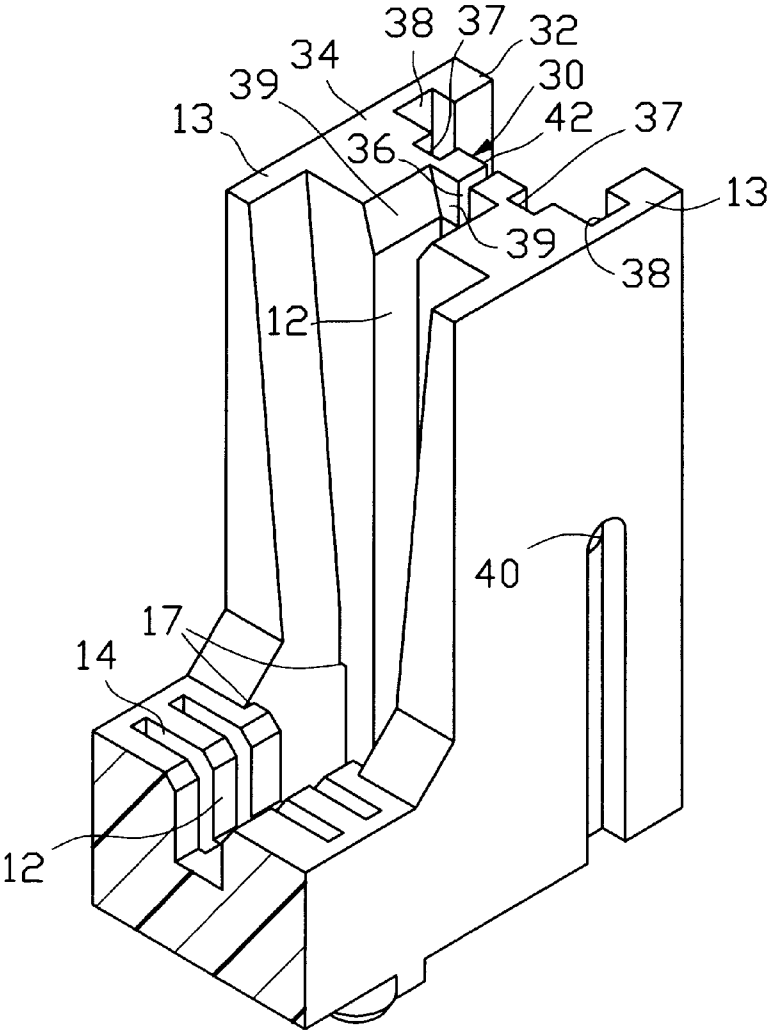
FIG. 2 is a perspective view of the right end portion of the housing of the socket of FIG. 1.

The important feature of the present invention is of the end portion of the housing 10 and the upright fixed latch 70 and the pivotable ejector 50 therein. With reference to FIG. 2, the right portion of the housing 10 includes a vertical cavity 30 positioned between the end wall 32 which is of the outermost position thereof and the retention wall 34 which is spaced away from but adjacent to such end wall 32 thereof wherein the end of the board slot 12 extends into the retention wall 34 so that the side portion of the daughter board inserted in the board slot 12 can be sandwiched by such retention wall 34. A narrow vertical passageway 36 extends, in a lengthwise direction along the housing 10 and in alignment with the board slot 12, through such retention wall 34 so that the board slot 12 is able to directly communicate with the cavity 30.

The cavity 30 further includes a pair of vertical recesses 38 extend transversely into the elongated side walls 13 which are positioned aside the board slot 12. Positioned approximate the bottom end of the recess 38 is a securing aperture 40 extending through the side wall 13 in a transverse direction. An indent 37 is disposed in the retention wall 34 adjacent each corresponding recess 38. A space 42 extends through the top portion of the end wall 32. Chamfers 39 are positioned on the top of the retention wall 36 adjacent the end of the board slot 12 in both lengthwise and transverse directions.

Figure 3:
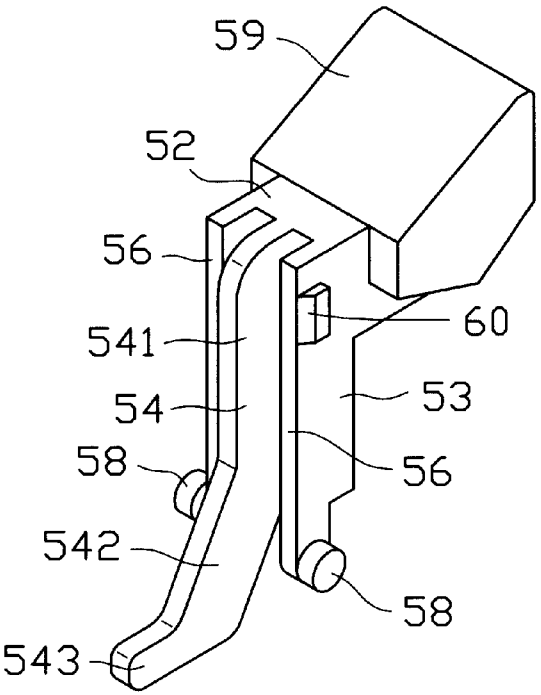
FIG. 3 is a perspective view of the ejector of FIG. 1.
Figure 7:
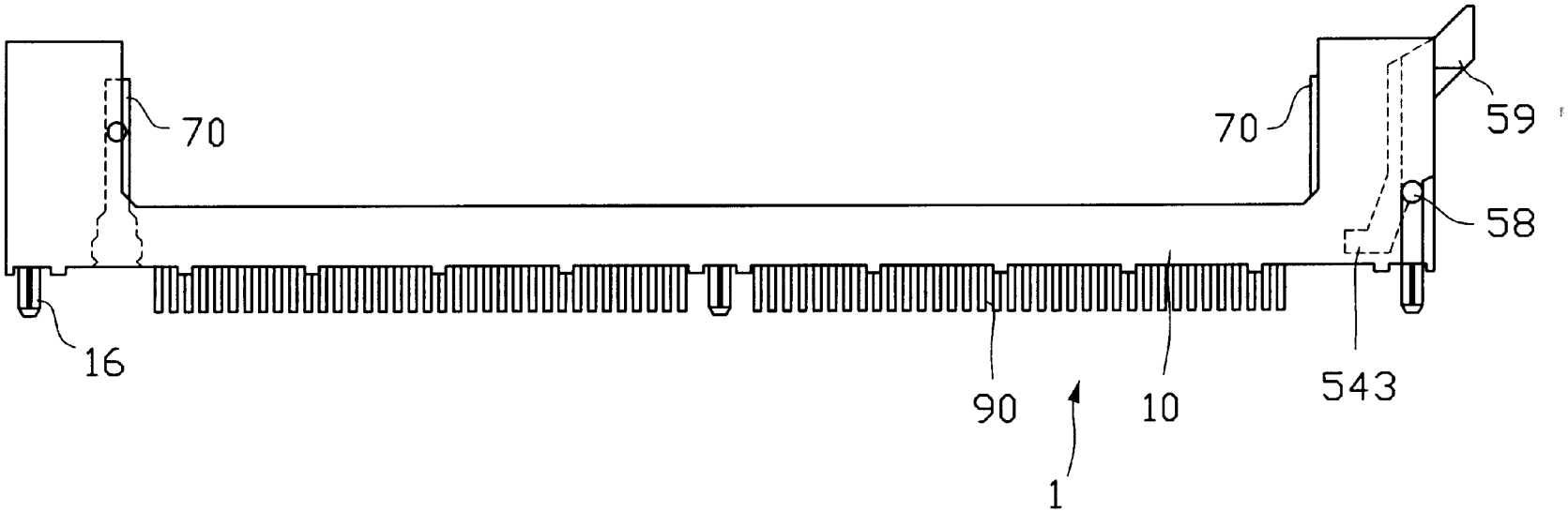
FIG. 7 is a front view of the socket of FIG. 1 to show the structure relation of the ejector and the latch with regard to the housing.

Correspondingly, referring to FIGS. 2 and 3, an ejector 50 is substantially positioned in the cavity 30, including a vertical main body 52 from which a hook section 54 extends forwardly wherein such hook section 54 is adapted to extend through the passageway 36 and into the board slot 12 in the housing 10. The hook section 54 includes a vertical first portion 541 integrally extending from the main body 52, a slanting second section 542 downward and forwardly extending from the end of the first section 541, and a horizontal third section 543 extending from the end of the second section 542. A pair of side bars 56 forwardly extend, from the main body 52, spaced from and beside the hook section 54. A detent 58 extends outwardly from the bottom end of each bar 56 for reception within the corresponding securing aperture 40. Oppositely, a retention protrusion 60 extends outwardly at the top end of each bar 56. The retention protrusion 60 of the ejector incorporating the end wall 32 of the housing 10, can restrain the ejector 50 within the cavity 30 in a locked manner. A lever 59 upwardly slantingly extends, backwardly from the top of the main body 52. The rear portion 53 of the main body 52 can be positioned within the space 42 when such ejector 50 is in a locking vertical position, as shown in FIG. 7.

Figure 4:
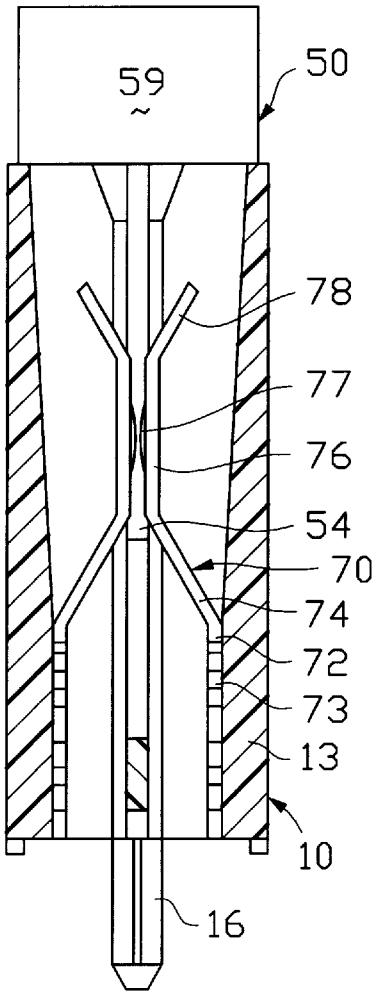
FIG. 4 is a cross-sectional view of the socket to show the latches therein.

Referring to FIGS. 1, 2, 4 and 6(A), a pair of latches 70 are positioned adjacent the inner side of the retention wall 34 and respectively beside the end of the board slot 12. Each latches 70 is in a form of strip and includes an expanded vertical base 72 at the bottom of which barbs 73 extends laterally on two sides for retainable reception within a pair of opposite grooves 17 in the housing 10. A converging section 74 extends upwardly from the top of the base 72 of each latch 70 so that such converging sections 74 of such pair of latches 70 are gradually close to each other. A vertical engaging section 76 is positioned at the top of the converging section 74 of each latch 70, and a diverging section 78 is positioned atop the such section 76 wherein an engagement projection 77 extends inwardly, i.e., in a direction to the central board slot 12 in the housing 10, on the inner surface of the engaging section 76. The distance between two opposite engaging sections 76 of such pair of latches 70 on two sides of the board slot 12, is substantially less than the width of the board slot 12 and the thickness of the daughter board inserted in the board slot 12, such that the latches 70 are deflected outwardly during insertion of such daughter board 100. To correspondingly comply with such deflection around the engaging section 76, the side walls 13 of the housing 10 have tapered configuration on the inner surfaces for allowing such outward deformation of the latch 70, as shown in FIG. 4. The structure relationship among the housing 10, the ejector 50 and the latch 70 can be referred to FIG. 7.

Figure 6A:
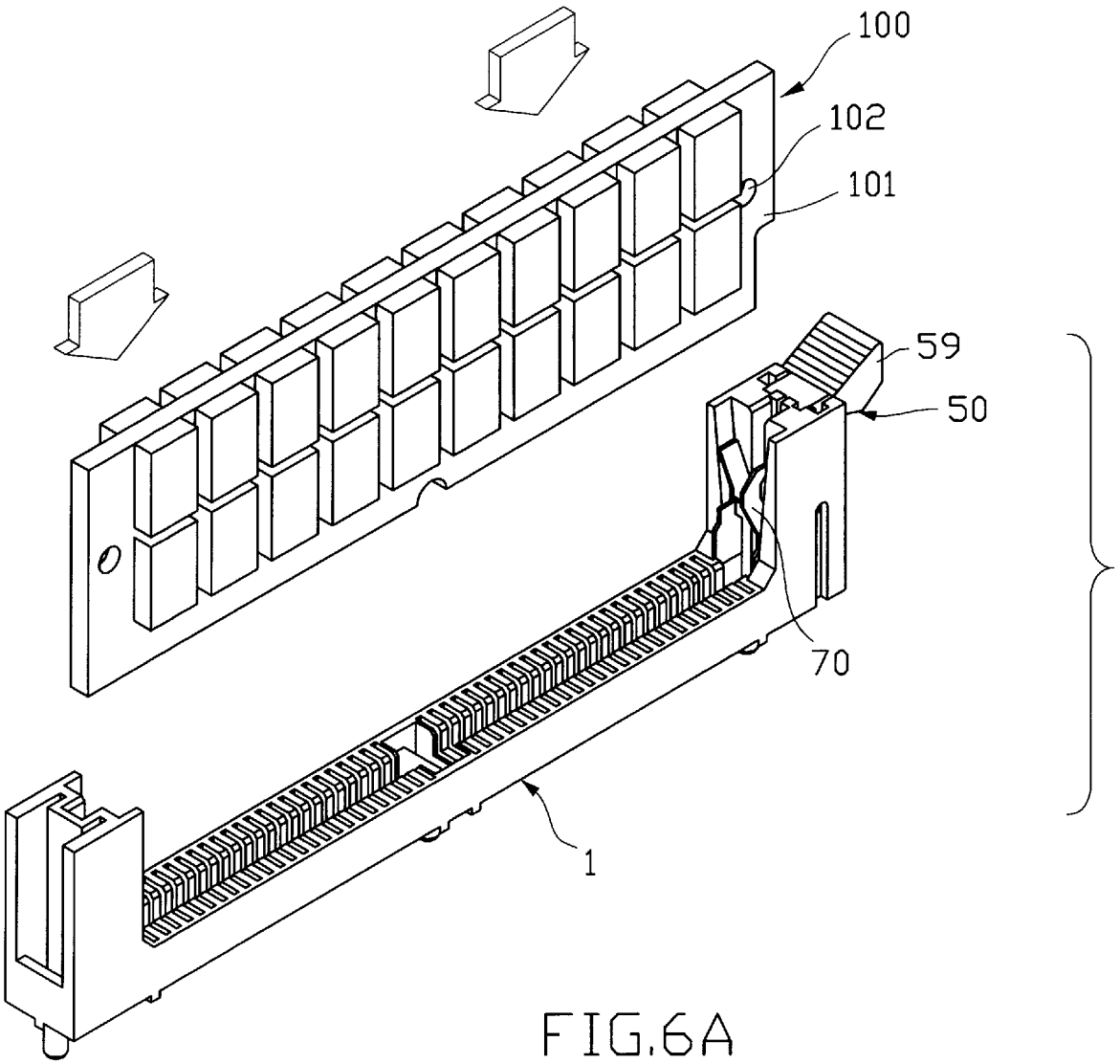
FIG. 6(A) is an assembled perspective view of the socket of FIG. 1 with a daughter board ready to mate.
Figure 6B:
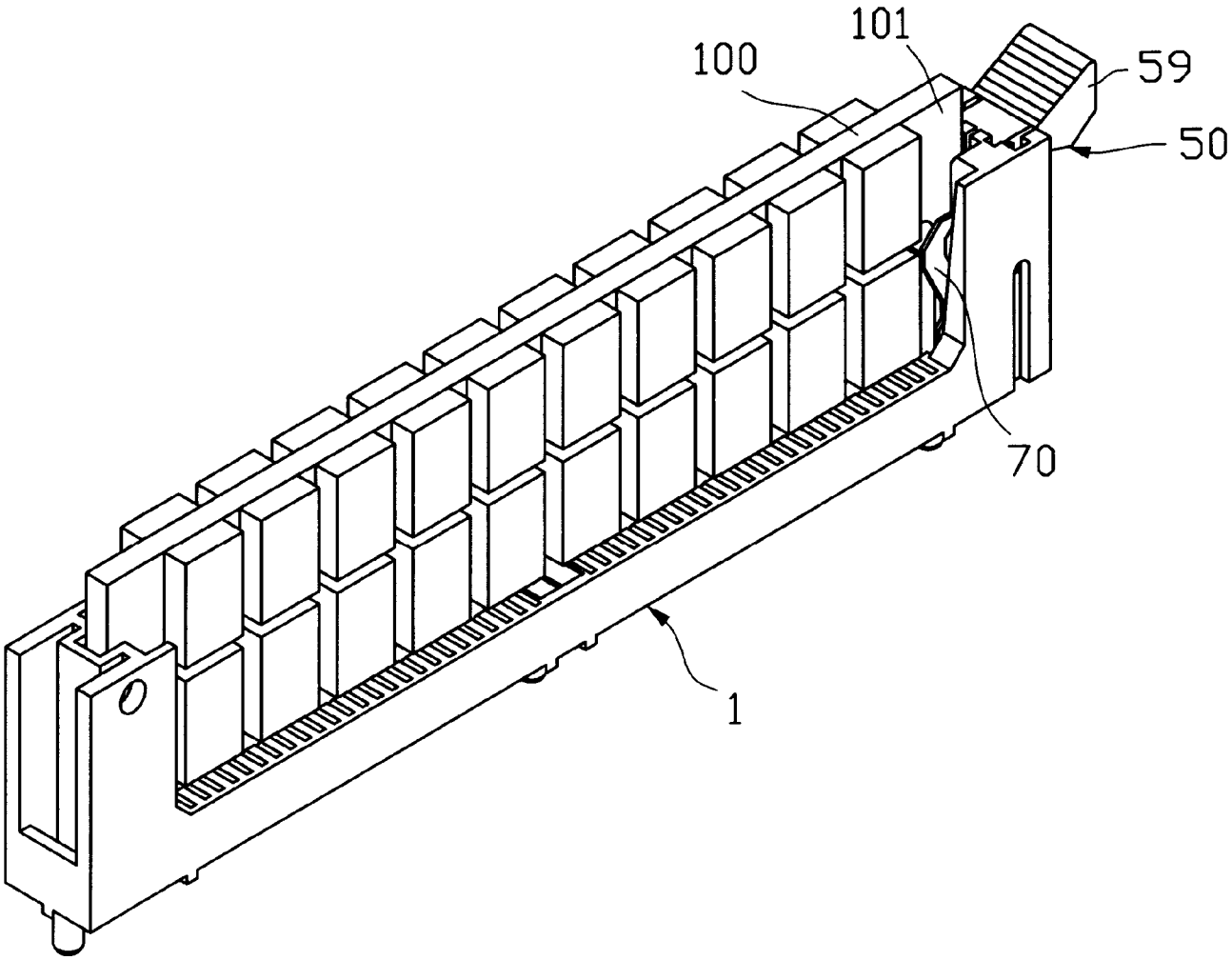
FIG. 6(B) is a perspective view of the socket of FIG. 6(A) equipped with the daughter board completely inserted therein.

As shown in FIG. 6(A), the daughter board 100 can loaded into the board slot 12 of the housing 10 from the top when the ejector 50 is in a locking vertical position. During this insertion, the chamfers 39 on the top of the retention wall 36 can guide the loading of the side edge portion 101 of the daughter board 100 in both lengthwise and lateral directions, and eventually the retention wall 36 restrains and orients the inserted daughter board in position. Therefore, such daughter board 100 can not move horizontally. In this situation, the engaging sections 76 of such pair of opposite latches 70 sandwiching the daughter board 100 therebetween are somewhat outwardly deflected for allowing insertion and reception of the daughter board 100 in the housing 10 wherein the engagement projections 77 are embedded in the retaining hole 102 in the daughter board 100. It can be understood that dimple type engagement projection 77 within the retaining hole 102 of the daughter board 100 functions as a stopper means for preventing the vertical movement of the daughter board 100 with regard to the housing 10, as shown in FIG. 6(B).

Figure 6C:
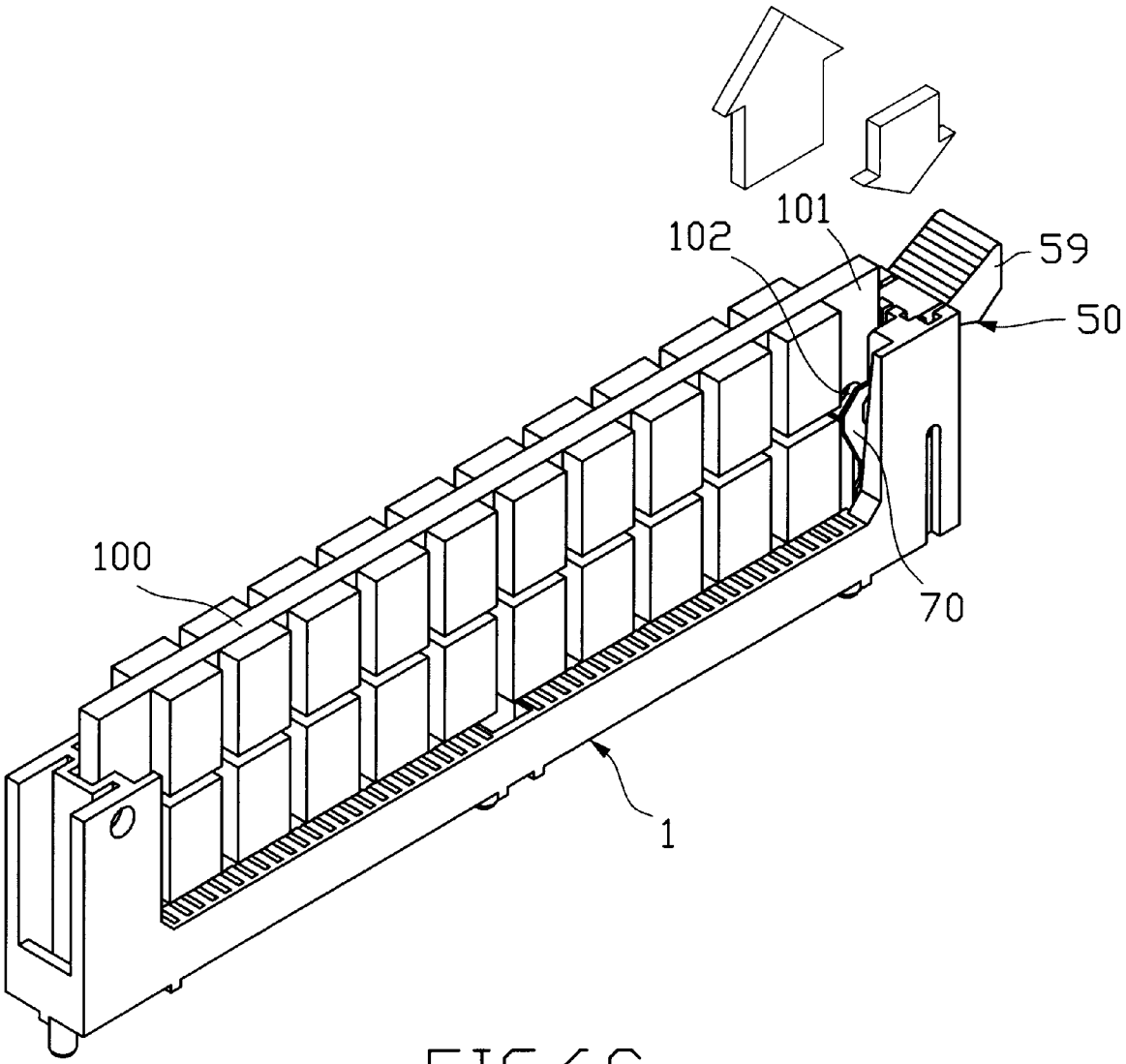
FIG. 6(C) is a perspective view of the socket of FIG. 6(A) with the inserted daughter board ready to leave.

When the daughter board 100 is intended to be removed from the housing 10, the ejector 50 is rotated around the detents 58 by manually pushing down the lever 59 and overcoming the interference between the retention protrusion 60 and the end wall 32, so that the third section 543 of the hook section 54, which is positioned below the lower edge of the daughter board 100, can be rotatively moved upward and push the right side lower corner of the above daughter board 100 upward. This upward pushing can force the, daughter board 100 to overcome the detention due to the engagement of the engagement projections 77 within the corresponding retaining hole 102 in the daughter board 100, and further push the engaging section 76 outwardly by means of the tips of the engagement projections 77 leaving the retaining hole 102 of the daughter board 100 and successively relatively moving along the surfaces of the daughter board 100. Therefore, the right side portion of the daughter board 100 can be released from the detention of the engagement projections 77 and be lifted upwardly, thus allowing for further removal of the whole daughter board 100 from the housing 10, as shown in FIG. 6(C).

It can be noted that two pairs of latches 70 are attached approximate two opposite ends of the board slot 12 in the housing 10 for corresponding to two retaining holes 102 at two side edge portions 101 of the daughter board 100. Differently, due to saving cost and satisfaction in operation, only one ejector 50 is installed in one end of the housing 10 in this embodiment for use to eject the inserted daughter board 100 from the housing 10. Understandably, another ejector 50 can be optimally placed at the left end of the housing 10 to cooperate with the existing right side ejector 50 for symmetrical ejection of the inserted daughter board loo from the housing 10. Moreover, the pair of the latches 70 sandwich the daughter board therebetween can provide balanced and symmetrical forces to the corresponding side edge portion 101 of the daughter board 100, so the whole board 100 is in a stable and even situation in the housing 10.

It is noted that the pair of latches 70 are open to the outside at their top portions for easy insertion of such daughter board 100 into the board slot 12 and also for easy inspecting the retainable engagement of the engagement projections 77 within the retaining hole 102 in the board 100. Additionally, the diverging sections 78 of such pair of latches 70 can guide and align the side edge portion 101 of the inserted daughter board 100 into the board slot 12 of the housing 10 and appropriately between such pair of latches 70.

It can be also seen that because the latch 70 and the ejector 50 are individually, structurally and functionally, independent from each other, the insertion of the daughter board 100 can be implemented with regard to the ejector in either locking vertical or releasing slanted position. The former situation has been described in FIG. 6(A), and in the latter situation the slanted ejector 50 can be re-positioned at the locking vertical position when the daughter board 100 is loaded into the housing 10 by means of the lower edge of the daughter board 100 pressing down the horizontal third portion 543 of the hook section 54 of the ejector 50, and thus rotating the ejector 50 about the detents 58.

Figure 5:
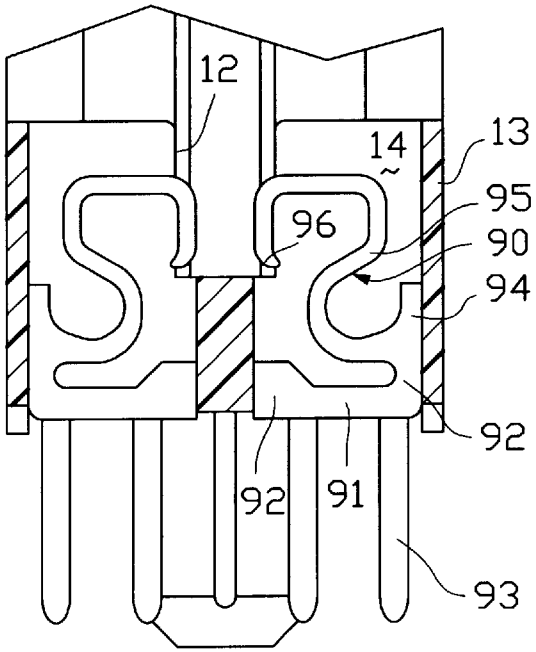
FIG. 5 is a cross-sectional view of the socket to show the contact therein.

As shown in FIG. 5, the contact 90 in each contact slot 14 includes a horizontal base 91 from two opposite ends of which a pair of retaining barb sections 92 extend upwardly for retainable engagement within the corresponding contact slot 14. Barbs respectively project outwardly laterally from such barb sections 92 for piercing into the housing 10. A tail 93 extend downward from the base 91 for insertion and soldering within corresponding holes of the mother board (not shown) on which the housing 10 is mounted. An extending post 94 extends atop the barb section 92 abutting the side wall 13 of the housing, from which a generally S-shaped contact beam 95 extends through the corresponding contact slot 14 and the distal end 96 of such contact beam 95 extends into the central board slot 12, so that when the daughter board 100 is inserted into the board slot 12, the circuit traces on the bottom edge portion of the daughter board loo can mechanically and electrically engage the corresponding contact 90, respectively.

While the present invention has been described with reference to a few specific embodiments, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

We claim:

1. A socket for use with a daughter board inserted therein, comprising:

an elongated insulative housing having a central board slot extending in a lengthwise direction along said housing for receiving a bottom edge portion of said daughter board therein;

a plurality of contact slots side by side transversely arranged along said central board slot;

a plurality of contacts respectively received within the corresponding contact slots;

a cavity positioned at one end of said housing and formed between an end wall and retention wall;

an ejector pivotally positioned within said cavity, hook means of said ejector extending into the central board slot and generally below a lower edge of the daughter board said hook means extending parallel to said lengthwise direction; and said central board slot substantially extending into the retention wall so as to form a trench in the retention wall while still maintaining solidity of the retention wall for being endurable to prevent deformation thereof whereby the retention wall can efficiently restrainably retain the daughter board in both the lengthwise direction and a lateral direction with regard to the housing.

* * * * *